United States Patent [19]

Rish

[11] Patent Number: 4,531,716

[45] Date of Patent: Jul. 30, 1985

[54] RATCHET PULLER FOR NAILS AND STAPLES

[75] Inventor: Fred D. Rish, Joliet, Ill.

[73] Assignee: Henry Ales, Joliet, Ill.

[21] Appl. No.: 531,322

[22] Filed: Sep. 12, 1983

[51] Int. Cl.[3] ..... B66F 15/00

[52] U.S. Cl. ..... 254/21

[58] Field of Search ..... 7/138; 81/61, 63.1, 81/64; 254/18, 21-25, 28

[56] References Cited

U.S. PATENT DOCUMENTS

| | | | |
|---|---|---|---|
| 1,492,900 | 5/1924 | Scott | 254/25 |
| 1,614,628 | 1/1927 | Pym | 254/18 |
| 2,978,081 | 4/1961 | Lundin | 81/63.1 |
| 3,126,195 | 3/1964 | Taylor | 254/28 |

*Primary Examiner*—Robert C. Watson

*Attorney, Agent, or Firm*—Ernest Kettelson

[57] ABSTRACT

A ratchet puller for nails and staples in accordance with this invention includes a ratchet lever or bar having a ratchet mechanism at one end with a tool mounting stud extending from the ratchet mechanism, and a pry tool for mounting thereon which includes a claw portion having a wedge slot for receiving the shanks of nails, spikes and similar items to be pried out of a piece of wood or other structure they are embedded in and which may include a pointed tip or stab to hook under the bight portion of staples and similar items for prying out of whatever they are embedded in. The pry tool includes a peripheral bearing surface to serve as a fulcrum when the ratchet lever or bar is moved causing the wedge slot, or pointed tip, of the tool to lift the nail shank, or staple as the case may be.

22 Claims, 13 Drawing Figures

RATCHET PULLER FOR NAILS AND STAPLES

BACKGROUND OF THE INVENTION

This invention relates to the field of tools and other devices for pulling nails, spikes, tacks, staples and the like from pieces of wood or other structures in which they are embedded.

The prior art includes a variety of tools for this purpose of many difference shapes and designs to grip the head of a nail or spike, or its shank and to then pry it out by leverage of the handle or bar. One problem that already known devices have not been able to solve effectively is that of reaching into a small space to grasp the head or shank of a nail for pulling it out wherein there is not enough room to move the handle or bar portion of the tool sufficiently to pry the nail out. The ratchet bar and pry tool mounted thereon in accordance with this invention is able to raise the nail in small step by step increments by reciprocating the ratchet handle or bar back and forth whatever short distances the small space allows.

Another problem with prior art devices to pull spikes, nails, staples and the like is their size, and the fact that a separate large bulky tool has to be carried or kept at hand by workmen in constuction trades, mechanics and the like for whenever spikes, nails and other items are encountered which have to be pulled. If they are not carried along or otherwise kept on hand, much time is lost by having to go and find a prying tool when such need does arise. The present invention solves much of this problem by providing a relatively small pry tool about the size of an ordinary socket tool for connection to a ratchet lever which can be the same ratchet lever workmen have in their tool box for use with sockets to tighten and remove bolts. The small pry tool can easily be stored in a small portion of the tool box, along with the sockets normally used with the ratchet bar, taking up very little space and adding very little to the total weight of the tools and box carried by the workman.

Examples of some prior art tools in this field include the staple and nail puller disclosed in U.S. Pat. No. 1,355,275 which includes a driving block that can be tapped or hit to seat the claw portion under the head of a nail; the spike puller shown in U.S. Pat. No. 1,311,948, having two pairs of link members connected to the pry bar to aid in pulling railroad spikes; the tack and staple puller in U.S. Pat. No. 894,969 wherein the gripping jaws are pivotally mounted to pivot between open and closed or gripping positions; the spike puller in U.S. Pat. No. 821,404 which has a ratchet wheel but not one which enables the pry bar to move relative to the claw portion of the tool; the purpose of the ratchet wheel in U.S. Pat. No. 821,404 is said to be to force the claws of the puller in such position to exert a pull on the spike vertically or straight thus preventing bending of the spike while being withdrawn; the combination tool in U.S. Pat. No. 572,406 which includes a nail puller in which the jaws are movable relative to each other between release and gripping positions; and the multi-purpose tool shown in U.S. Pat. No. 184,775 which includes a claw member at one end of an elongated handle or bar.

SUMMARY OF THE INVENTION

It is an object of the invention to provide a ratchet puller for nails, staples and similar items comprising a two part tool wherein one part is separable from the other, one part being a ratchet bar useable with other connectable tools, the other part being the pry end of the tool.

It is an object of the invention to provide a ratchet puller for nails, staples and similar items which takes up little additional space and adds little additional weight, thereby being easy to carry and keep on hand for immediate use when needed.

It is an object of the invention to provide a ratchet puller for nails, staples and similar items which can reach and pull such items when located in small spaces with room for only very small movements of the bar portion of the tool.

It is an object of the invention to provide a ratchet puller for nails, staples and similar items, comprising a ratchet bar having a ratchet mechanism at one end, a connecting stud projecting from said ratchet mechanism, a pry tool connectable to said connecting stud, said pry tool including a claw portion having a wedge slot for pulling nails and a stab or pointed tip portion for pulling staples.

It is an object of the invention to provide a ratchet puller for nails, staples and similar items as part of a combination socket wrench tool for connection to a ratchet lever used with such socket wrench tool.

DESCRIPTION OF PREFERRED EMBODIMENT

Figure 1:
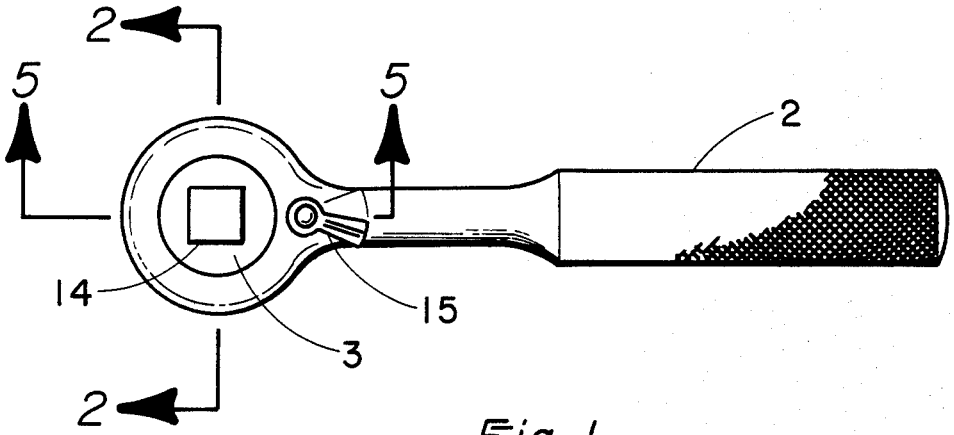
FIG. 1 is a plan view of a ratchet bar for use in accordance with this invention.
Figure 2:
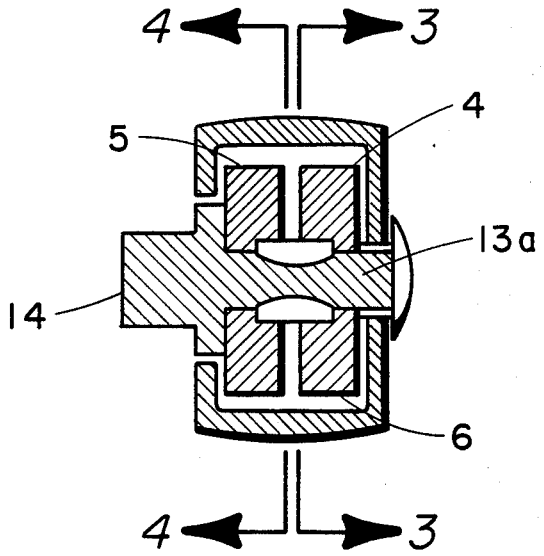
FIG. 2 is a section view taken on line 2—2 of FIG. 1.
Figure 3:
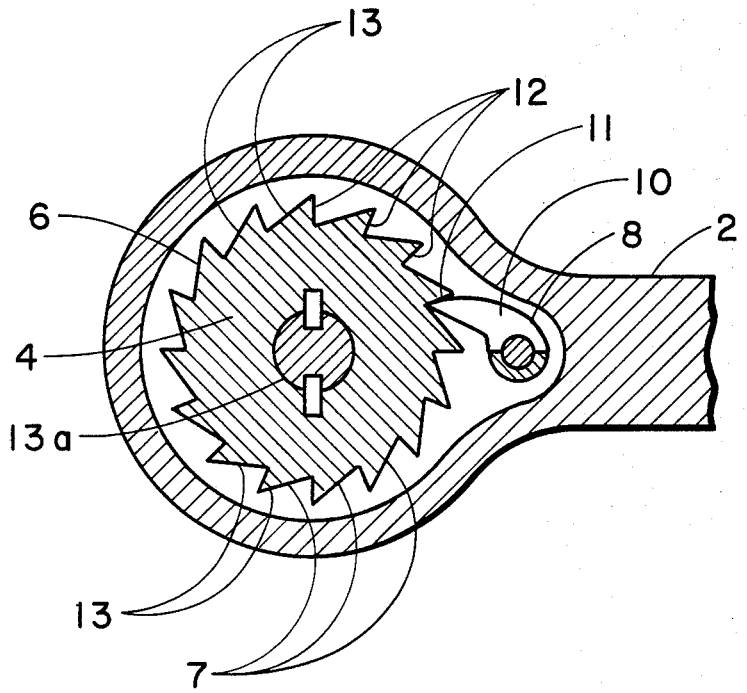
FIG. 3 is a section view taken on line 3—3 of FIG. 2.
Figure 4:
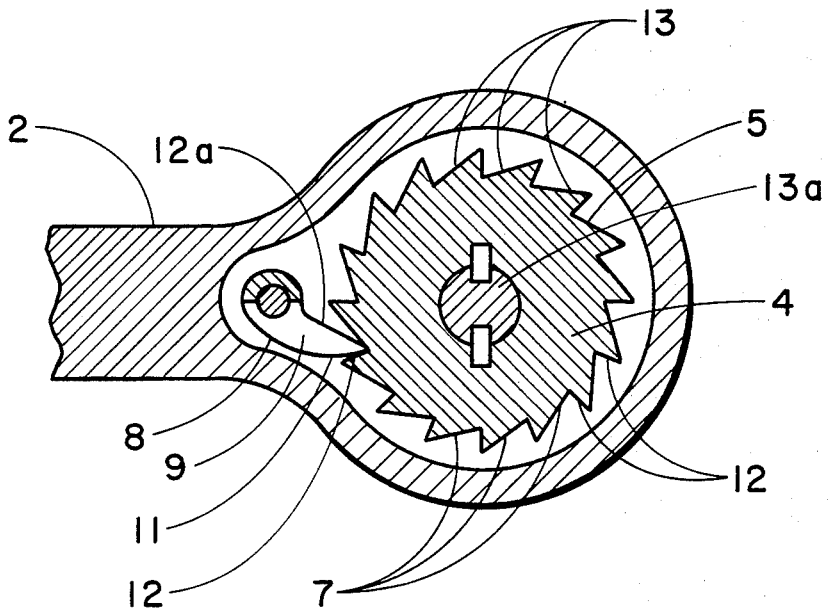
FIG. 4 is a section view taken on line 4—4 of FIG. 2.
Figure 5:
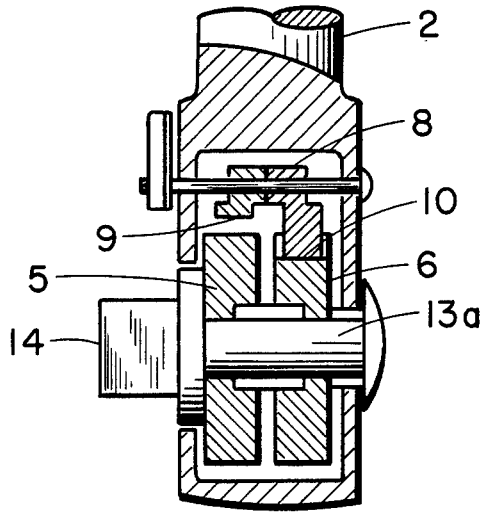
FIG. 5 is a section view taken on line 5—5 of FIG. 1.
Figure 6:
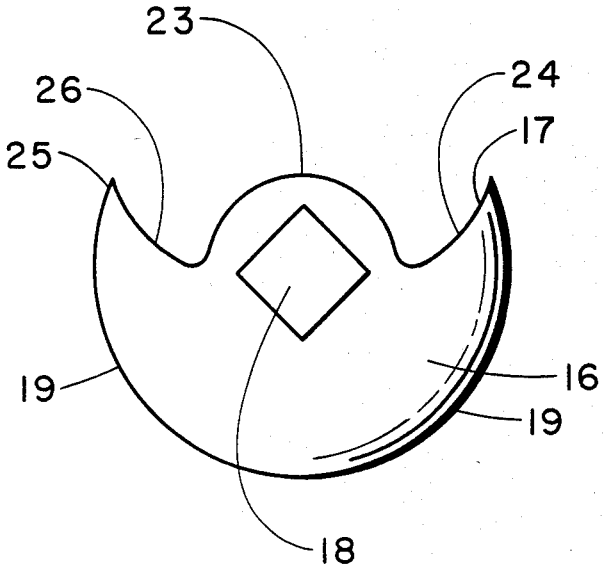
FIG. 6 is a side elevation view of a pry tool in accordance with this invention for use with a ratchet bar as shown in FIG. 1.
Figure 7:
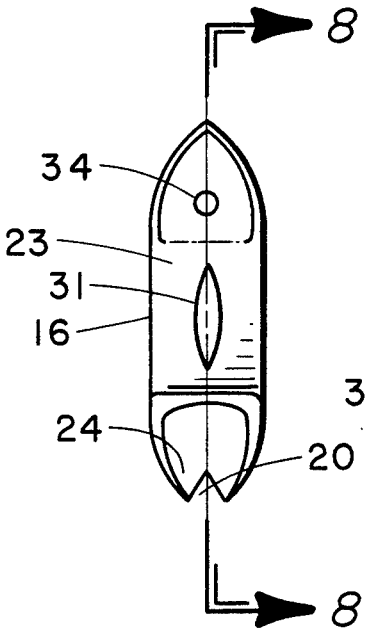
FIG. 7 is a front elevation view of the pry tool shown in FIG. 6.

A ratchet puller 1 for nails, spikes, tacks, staples and similar items, includes a ratchet bar or lever 2 having a ratchet mechanism 3 therein, comprising a ratchet wheel 4 having two rows 5 and 6 of inclined teeth 7 around its circumference, the teeth 7 of row 5 being inclined upwardly in one direction and the teeth 7 in row 6 being inclined upwardly in the opposite direction, a two detent pawl 8 pivotally mounted on the ratchet bar 2, having a first detent 9 positioned in registration with the teeth 7 in row 5 and a second detent 10 positioned in registration with the teeth 7 in row 6, the pivotally mounted pawl 8 being pivoted between a first position in which first detent 9 is dropped into operating communication with teeth 7 of row 5 of the ratchet wheel 4 and a second position in which second detent 10 is dropped into operating communication with teeth 7 of row 6 of the ratchet wheel 4.

When first detent 9 is in operating communication with teeth 7 of row 5, the flat face 11 of detent 9 bears against the flat face 12 of teeth 7 in row 5 when the ratchet bar 2 is moved in a first direction of rotation thus making ratchet wheel 4 rotate in said first direction of rotation. When ratchet bar 2 is moved in the opposite direction with first detent 9 in communication with teeth 7 of row 5, the inclined surface 12*a* of detent 9 glides over the inclined surface 13 of the teeth 7 without rotating the ratchet wheel 4, and when movement of ratchet bar 2 is stopped, the first detent 9 of two detent pawl 8 drops into a space between the teeth 7 with its flat face 11 engaging and bearing against flat face 12 of the corresponding tooth 7. When ratchet bar 2 is again moved in said first direction of rotation with two detent pawl 8 in registration with row 5 of ratchet wheel 4, the ratchet wheel 4 is moved a further distance in said first direction of rotation. A drive shaft 13*a* is connected to said ratchet wheel 4 and rotates in the same direction as said ratchet wheel 4. A connecting lug 14 is connected to said drive shaft 13.

When second detent 10 is in operating communication with teeth 7 of row 6, the flat face 11 of detent 10 bears against the flat face 12 of teeth 7 in row 6 when the ratchet bar 2 is moved in a second direction of rotation thus making ratchet wheel 4 rotate in said second direction of rotation. When ratchet bar 2 is moved the opposite direction with second detent 10 in communication with teeth 7 of row 6, the inclined surface 12 of detent 10 glides over the inclined surface 13 of the teeth 7 without rotating the rotatable wheel 4, and when movement of ratchet bar 2 is stopped, the second detent 10 of two detent pawl 8 drops into a space between the teeth 7 with its flat face 11 engaging and bearing against flat face 12 of the corresponding tooth 7. When ratchet bar 2 is again moved in said second direction of rotation with two detent pawl 8 in registration with row 6 of ratchet wheel 4, the ratchet wheel 4 is moved a further distance in said second direction of rotation. The drive shaft 13*a* connected to ratchet wheel 4, and the lug 14 connected to the drive shaft 13*a* also thereby rotates in said second direction of rotation.

A change of direction lever 15 is positioned along the side wall of the ratchet bar 2 connected to the two detent pawl 8 to pivot it between said first and second positions.

A pry tool 16 having a claw portion 17 for pulling nails is provided with a mounting recess 18 corresponding in dimension and cross-section to that of lug 14 of the ratchet bar 2 for operatively mounting the pry tool 16 on the lug 14 of ratchet bar 2.

The pry tool 16 includes a peripheral bearing surface 19, which may be arcuately shaped in peripheral configuration as shown in the drawing or which may have other peripheral shapes such as straight or angled.

The claw portion 17 of pry tool 16 includes a wedge shaped slot 20 bounded on each side by claw fingers 21 and 22, which extend outwardly from the hub 23 having a pry surface 24 facing radially inwardly and said bearing surface 19 on the opposite side of said claw fingers and of said pry tool facing radially outwardly.

A pointed tip or stab portion 25 is provided on the pry tool 16, on the opposite side of the hub 23 from the claw portion 17, for pulling staples or other items having a pair of legs or shanks embedded in something such as a piece of wood, said legs or shanks connected by a crosspiece or bight portion. The stab 25 includes a pry surface 26 facing radially inwardly and on the opposite side includes said bearing surface 19 facing radially outwardly.

The axis of rotation of the recess 18 in the hub 23 extends laterally or at right angles to the longitudinal axes of a nail 27 received in the wedge shaped slot 20 of claw portion 17, or the legs 28 of a staple 29 whose bight portion 30 is engaged by the tip or stab portion 25.

The outer peripheral surface of hub 23 includes a positioning groove 31 aligned with the wedge shaped slot 20 of the claw portion 17, in which a nail 27 may be laid with its pointed end 32 projecting outwardly from the wedge shaped slot 20 and its head 33 extending rearwardly from the hub 23 and from pry tool 16. When used in this manner, with pry tool 16 mounted on ratchet bar 2, the nail 27 can be held in position for hammering to start it in the desired position.

A second nail positioning means is provided by a bore 34 through the stab portion 25 having a diameter corresponding to that of the nails 27 which are to be used with the device. The pointed end 32 of the nail 27 projects outwardly from the bore 34, the shank 35 of the nail 27 rests on the outer peripheral wall of the hub 23 and the head 33 of the nail 17 extending rearwardly from the hub 23 and from pry tool 16.

Figure 9:
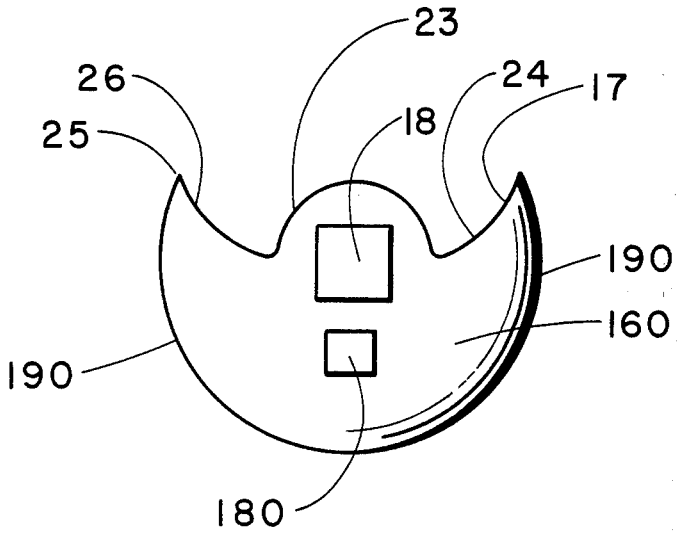
FIG. 9 is a side elevation view of a modified form of a pry tool in accordance with this invention.

A modified form of the pry tool 160 is shown in FIG. 9 and includes not only mounting recess 18 through the hub 23, but a second mounting recess 180 of different cross-sectional dimension than mounting recess 18, to receive a different sized lug 14 of a ratchet bar 2. For example, the cross-sectional dimension of recess 18 may receive a one-half inch lug, and that of the recess 180 may receive a three-eighths inch lug. The provision of a plurality of mounting recesses in pry tool 16 increases its versatility for use with additional ratchet bars.

Figure 10:
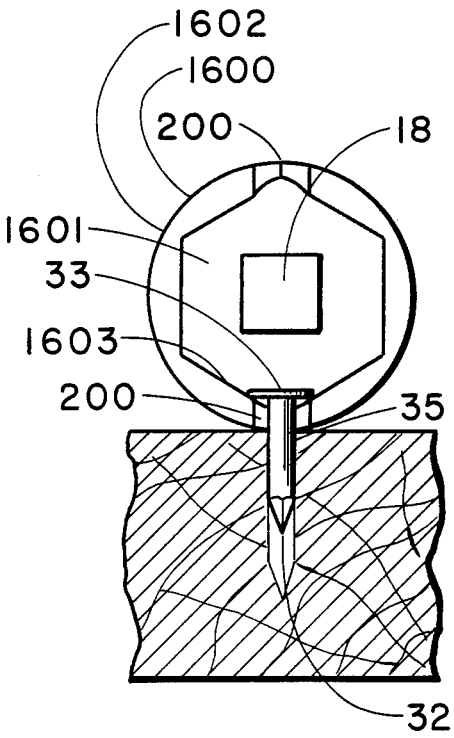
FIG. 10 is a front elevation view of another embodiment of this invention comprising a socket wrench having wedge slots in its side wall, showing a nail gripped in one of said wedge slots ready to be pulled out from a piece of wood.
Figure 11:
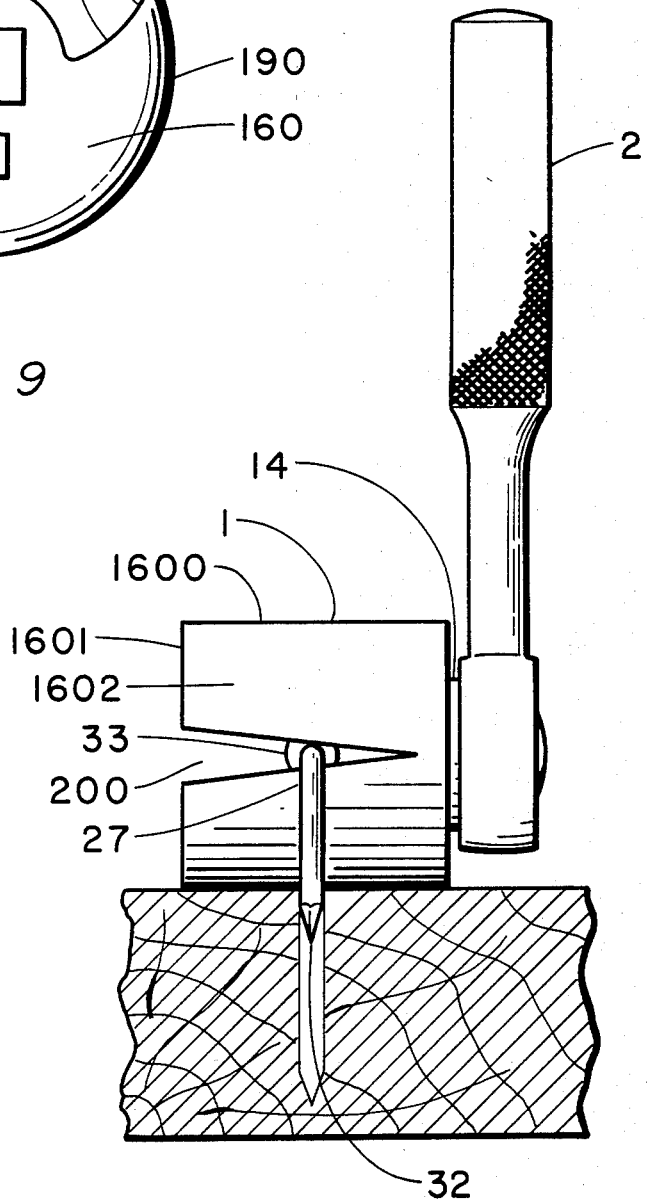
FIG. 11 is a side elevation view of the embodiment of this invention shown in FIG. 10 after having been rotated to pull the nail out of the piece of wood.

Another modified form of the pry tool 1600 is shown in FIGS. 10 and 11 and includes a pre-existing socket wrench tool 1601 in which a pair of wedge shaped slots 200 have been cut in the peripheral wall 1602 of socket 1601. In this modification the socket tool 1601 is placed on the lug 14 of ratchet bar 2 in the normal manner, and the shank 35 of a nail 17 to be pulled is then received in one of the slots 200 with its head 33 along the inner surface 1603 of the peripheral wall 1602 of the socket 1601.

The pry tool 16, 160 and 1600 in accordance with this invention is a compact unit whose peripheral wall or bearing surface 19, 190 and 1602 respectively is preferably arcuate, and which may have an external diameter of no greater than between one and one-half inch to two and one-half inches. The diameter of the ratchet mechanism 3 and the ratchet wheel 4 of the ratchet bar 2 in accordance with this invention, for use with pry tools having an external diameter no greater than two and one-half inches, need be no larger than about one and one-fourth inches. Thus, the relationship between the size of the diameter of the pry tool in accordance with this invention and that of the ratchet wheel mechanism with which it is to be used is about two to one or less, that is the outer diameter of the pry tool 16, 160 and 1600 need be no greater than about twice the diameter of the ratchet wheel 4 or ratchet mechanism 3 mounted in a ratchet bar 2. Such structure means that the longitudinal axis through the ratchet bar 2 when connected to pry tool 16 is no greater than one and one-quarter inches radially from the outer peripheral wall or bearing surface 19 of the tool 16, 190 of the tool 160, and 1602 of the tool 1600.

By providing a pry tool 16, 160 and 1600 of such compact size and arcuate peripheral configuration, a workman can get into very small openings and very small quarters with the pry tool 16, 160 or 1600 (as desired) connected to the lug 14 of a ratchet bar 2, for grasping a nail 27 in the wedge slot 20 of the claw portion 17 or engaging a staple 29 with the pointed end or stab portion 25 of the pry tool 16 and 160, or if pry tool 1600 is being used grasping a nail 27 in wedge slot 200 provided in the peripheral wall 1602. Even though there may be little room to move the ratchet bar 2 back and forth, the ratchet mechanism 3 enables the pry tool to rotate a short distance in the pulling out direction when the bar 2 is moved in that direction, then hold such position when the ratchet bar 2 is moved back in the opposite direction as far as it can be moved, with the pawl 8 sliding over the inclined surface 13 of one or more of the teeth 7 of the ratchet wheel 4 until the bar 2 cannot be moved any further, the flat face 11 of the pawl then dropping into the slot between teeth 7 to face and engage the corresponding flat face 12 of the then adjacent tooth 7 when the ratchet bar 2 is again moved in the pulling out direction as far as it can go. This rotates the ratchet lug 14 and pry tool a further distance in the pulling out direction, thus pulling the nail 27 or staple 29 a further distance out of the structure in which it is embedded. The process of ratcheting back and forth whatever short distances permitted by the small size of the opening available is repeated by the workman until the staple or nail is eventually pulled completely out.

The axial cross-sectional dimension of the pry tool 16 and 160 as shown and described herein is not greater than about three-quarters of an inch. The corresponding cross-sectional dimension or thickness of the ratchet mechanism 3 at the working end of ratchet bar 2 is also no greater than about three-quarters of an inch. Therefore the tool can be used to reach down into an opening no wider than about one and one-half to two inches to reach a nail or staple for removal. The ratchet bar 2 need move forward and backward no more than an inch to at least move the pawl 8 from one tooth 7 to engage another tooth 7, so the ratchet puller 1 in accordance with this invention is useable in as little space as a lateral opening one and one-half to two inches wide, and a longitudinal opening of from one to two inches long.

The pry tool in accordance with this invention may also be used with an elongated extension lug connected to the lug 14 of the ratchet bar 2, for use where the pry tool has to be dropped or lowered on its side into a narrow opening for removal of a nail or staple from a side wall of such narrow opening.

Figure 8:
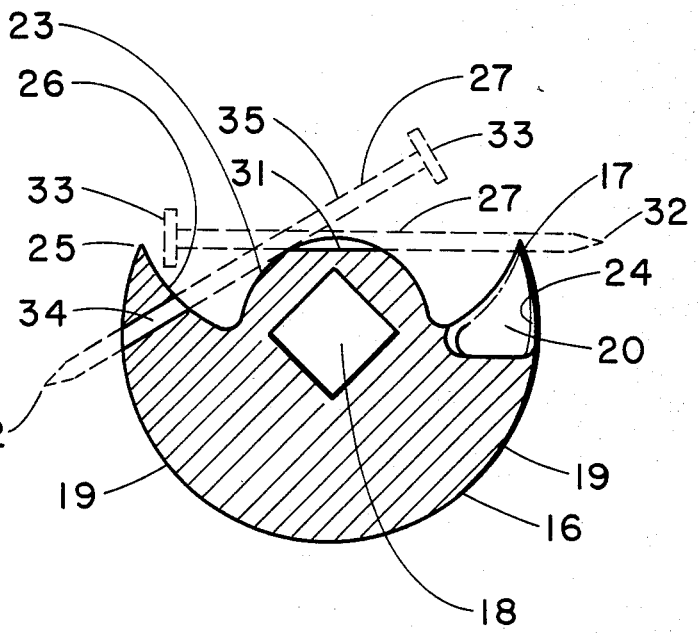
FIG. 8 is a section view of the pry tool taken on line 8—8 of FIG. 7 showing two nails in phantom with broken lines, one positioned in a groove alined with the wedge slot of the claw portion of the tool and the other extending through a bore through the body of the pointed or stab portion of the pry tool.

The pry tool 16 and 160 include a positioning groove 31 for a nail 27 to lie with its shank 35 projecting through the wedge slot 20 of the claw portion 17 as shown in FIG. 8 where a nail 27 is shown in phantom by broken lines resting in the groove 31 and through the slot 20 of claw portion 17 with its pointed end 32 extending outwardly beyond the body of the pry tool. When the pry tool is mounted on the ratchet bar 2, a workman can easily hold the pry tool 16, or 160, in position where the pointed end 32 of nail 27 is lined up in registration with the point where it is to be hammered in place. The head 33 of the nail 27 projects rearwardly from the body of the pry tool 16, or 160, where the workman can hit the head with a hammer held in his other hand. Thus, the pry tool in accordance with this invention includes nail positioning means to start a nail in the proper location for then hammering home.

A second nail positioning means is the bore 34 through the pointed end or stab portion 25, also as shown in FIG. 8 wherein a second nail is shown in phantom extending through the positioning bore 34. In this positioning means, the nail 27 would have to be withdrawn after a starting hole had been made, the nail removed from the bore 34, then placed in the starting hole and after that hammered home.

The pry tool 1600 also includes nail positioning means, since the wedge slots 200 are aligned on opposite portions of the side wall 1602. Thus, the shank 35 of a nail 27 can be held in position for starting by placing it in both of the aligned wedge slots 200, then holding the tool 1600 in place by the ratchet bar 2 to which it is connected with the pointed end 32 of the nail 27 in registration with the point where it is to be hammered in. The nail head 33 is tapped sufficiently until the nail holds its position, the pry tool 1600 is removed from the nail shank 35, and the nail can then be hammered home.

The structure and dimensions of the pry tools 16, 160 and 1600 in accordance with this invention, and the ratchet bar 2 to which such pry tools are connectable, is such that the outer peripheral wall or bearing surface 19, 190 and 1602 is spaced no farther apart at any point from the longitudinal axis of the elongated ratchet bar 2 when pry tools 16, 160 and 1600 are connected to the ratchet bar 2, than a fraction of the length of the shank 35 of the longest nail 27 which pry tools 16, 160 and 1600 are able to pull out of a piece of wood or other structure in which such nail is embedded.

Figure 12:
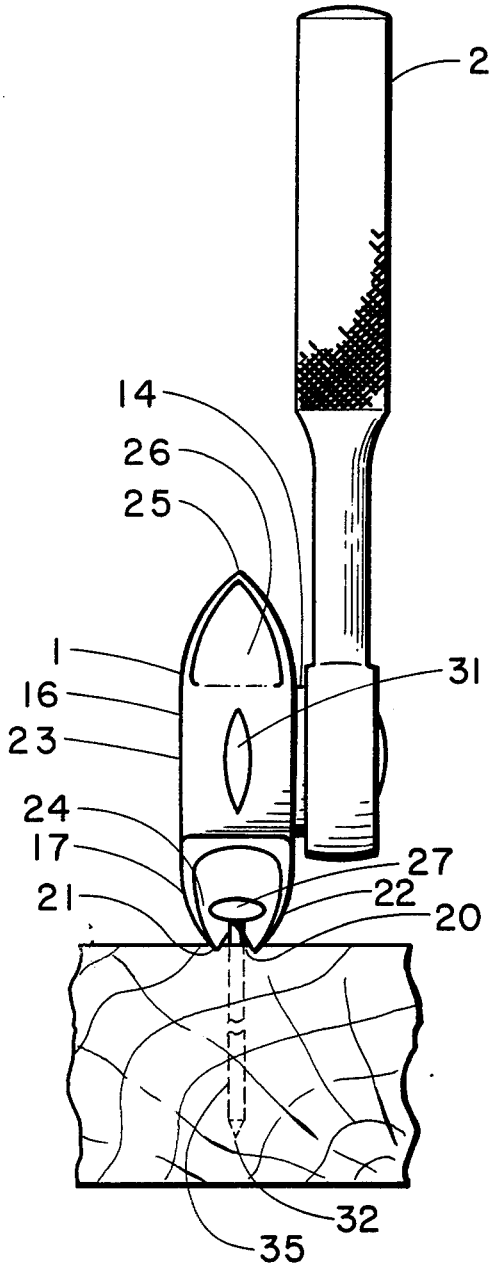
FIG. 12 is a front elevation view of a pry tool in accordance with this invention as shown in FIG. 7, illustrating a nail gripped in the wedge slot of the claw portion of the pry tool ready to be pulled out of a piece of wood, and having a ratchet bar as shown in FIG. 1 connected to the pry tool.
Figure 13:
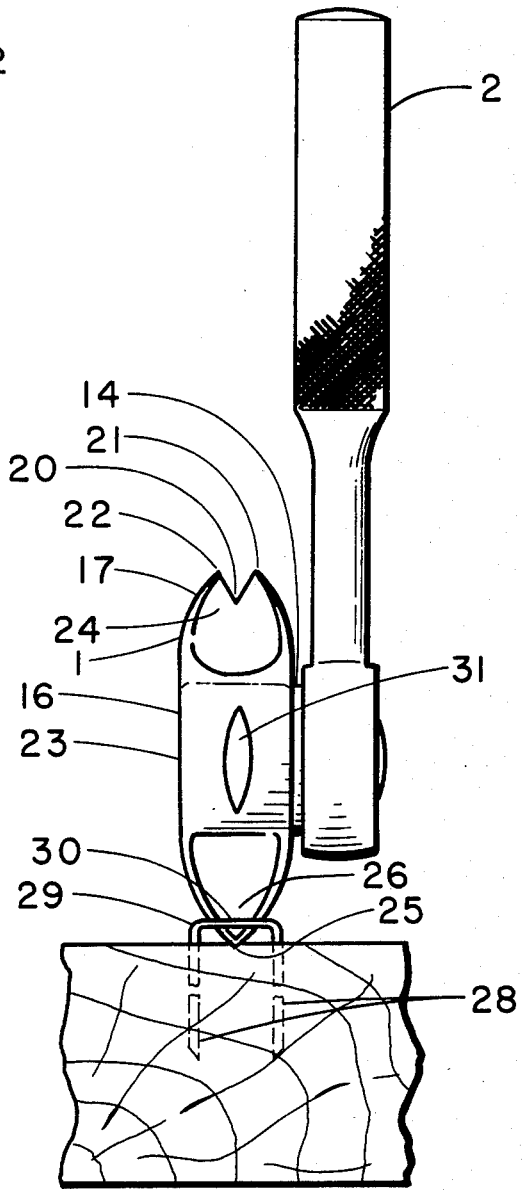
FIG. 13 is a front elevation view of a pry tool in accordance with this invention as shown in FIG. 7, illustrating the pry tool having its pointed end or stab portion inserted under the bight portion of a staple ready to pull the staple out of a piece of wood in which it is embedded, and illustrating a ratchet bar as shown in FIG. 1 connected to the pry tool.

In other words, a pry tool 16, 160 or 1600 whose outer peripheral wall 19, 190 or 1602 is no greater than one and one-quarter inches from the longitudinal axis of ratchet bar 2, is able to pull a nail 27 or staple 29 out of a piece of wood whose shank 35 or legs 28 respectively are embedded in the wood more than one and one-quarter inches. They may be embedded as far as six times or more the distance of said outer peripheral wall from said longitudinal axis. If such distance is one and one-quarter inches, the nail 27 could have an embedded shank seven and one-half inches long. The ratchet puller in accordance with this invention having a pry tool at one end thereof which extends outwardly from the longitudinal axis of ratchet bar 2 much less than seven and one-half inches is still able to pull such nails or staples out from whatever they are embedded in. The nail 27 shown in FIG. 12 represents one having its shank 35 embedded in the wood such distance. The sides 21 and 22 of claw portion 17 bordering wedge slot 20 extend radially outwardly from the longitudinal axis of ratchet bar 2 no more than one and one-quarter inches at their outermost point, and the peripheral wall or bearing surface 9 also extends radially outwardly from the longitudinal axis of ratchet bar 2 no more than one and one-quarter inches.

Thus, the pry tools 16, 160 and 1600 in accordance with this invention are able to pull nails, spikes and the like which are longer relative to the dimension between the gripping portion and rotational axis of the tool than any pry tools known to the prior art. The arcuate peripheral wall and bearing surface 19, 190 and 1602 permit the ratchet bar 2 to rotate pry tools 16, 160 and 1600 in a complete circle, whereby the nail head 33 gripped in the wedge slot 20 or 200 can be brought around through a complete three hundred and sixty degree circle with the nail shank 35 bending around the peripheral wall bearing surface 19, 190 and 1602 until the sharp pointed end 32 of the nail 27 is pulled out of the wood or whatever it was embedded in. Thus, nails, spikes and the like which are as long as the circumferential path around the pry tools of this invention can be pulled completely out. Since the circumference equals diameter times "PI" (3.14159265), pry tools in accordance with this invention are able to exert pulling out force on nails, spikes and the like through a distance more than three times the diameter across the body of the pry tool from one point on its arcuate peripheral surface to a diametrically opposite point on such arcuate peripheral surface, and more than six times the radius, or the distance from the axis of rotation of the pry tools in accordance with this invention and the arcuate peripheral wall and bearing surface of such pry tools. Another way of describing this feature of the invention is that a pry tool having an arcuate peripheral bearing surface 19, 190 and 1602 in accordance with this invention and an axis of rotation around the mounting recess 18 or 180 as the case may be can pull embedded nails or spikes which are more than six times longer than the distance between such axis of rotation and such arcuate peripheral bearing surface.

This means that the arcuate peripheral surface of pry tools in accordance with this invention can be much closer to the longitudinal axis of the elongated bar portion of the tool than prior art crow bars and other pry tools known to the prior art, and still pull out nails and spikes of the same length or longer. In other words, the working end of the tool in accordance with this invention can be much smaller and compact than prior art devices.

I claim:

1. A ratchet puller for nails, spikes, tacks, staples and elongated members having a shank embedded in a structure from which it is to be pulled, comprising a detachable pry tool having mounting means to rotatably mount to an elongated bar, including said elongated bar, ratchet means operably connected between said pry tool and said elongated bar for ratchet operation of said pry tool, said pry tool including an outer peripheral wall, grasping means at a point along said peripheral wall to grasp a said elongated member for pulling from said structure in which it is embedded, said grasping means being rotatable through a circular path while grasping said elongated member thereby carrying said elongated member upwardly out of said structure in which it was embedded and over said peripheral wall of said pry tool as it travels in said circular path, said outer peripheral wall extending in a semi-circle for a distance of at least one hundred and eighty degrees.

2. A ratchet puller as set forth in claim 1, wherein said grasping means is rotatable through said circular path a distance of three hundred sixty degrees, said pry tool thereby being able to pull a said elongated member more than three times longer than the diameter of said circular path out of a structure in which it is embedded as said elongated member is carried over said outer peripheral wall of said pry tool as it travels through said three hundred sixty degree circular path.

3. A ratchet puller as set forth in claim 2, said pry tool being small in radial dimension relative to the length of embedded elongated members it is useable with in close quarters, the radial distance of the longitudinal axis of said elongated bar from said outer peripheral wall of said pry tool when connected thereto being no greater than one-sixth the length of said three hundred and sixty degree circular path and a corresponding elongated member of such length.

4. A ratchet puller as set forth in claim 3, wherein said outer peripheral wall of said pry tool is spaced apart radially from said longitudinal axis of said elongated bar no farther than one and one-quarter inches in any direction and said shank of said elongated member is embedded in said structure more than one and one-quarter inches.

5. A ratchet puller as set forth in claim 1, wherein said grasping means includes a claw portion having a wedge shaped slot therein to receive the shank of a nail therein for pulling from a structure in which said nail is embedded.

6. A ratchet puller as set forth in claim 1, wherein said pry tool includes a pointed end portion to insert under the bight of a staple for pulling from a structure in which said staple is embedded.

7. A ratchet puller as set forth in claim 5, wherein said pry tool includes a body portion, a groove in said body portion axially aligned with said wedge shaped slot for laying a nail in said groove and through said slot to position said nail for starting and hammering into a pre-selected location.

8. A ratchet puller as set forth in claim 6, wherein said pry tool includes a bore through said pointed end portion, said bore having a diameter corresponding to that of a nail to be received through said bore for positioning said nail for starting prior to hammering into a pre-selected location.

9. A ratchet puller as set forth in claim 3, wherein said ratchet means is mounted in an end portion of said elongated bar, said ratchet means including a projecting lug extending therefrom, said mounting means of said pry tool including a first recess therein of corresponding shape and dimension to that of said projecting lug of said ratchet means.

10. A ratchet puller as set forth in claim 9, wherein said mounting means of said pry tool includes a second recess therein of different dimension than said first recess to receive a said mounting lug of correspondingly different dimension.

11. A ratchet puller as set forth in claim 1, wherein said pry tool includes a body portion having an arcuate peripheral wall, said arcuate peripheral wall terminating at one circumferential side portion in a claw portion having a wedge shaped slot therein, said claw portion comprising said grasping means, said arcuate peripheral wall terminating at an opposite circumferential side portion in a pointed end portion, said claw portion and said pointed end portion each having respective pry surfaces facing oppositely from said arcuate peripheral wall.

12. A ratchet puller as set forth in claim 1, wherein said pry tool includes a socket wrench member, said socket wrench member including a cylindrical peripheral wall, a first wedge slot in said peripheral wall to receive the shank of a nail for pulling from a structure in which said nail is embedded.

13. A ratchet puller as set forth in claim 12, wherein said socket wrench member includes a second wedge slot in said peripheral wall, said second wedge slot positioned oppositely of said first wedge slot and diametrically aligned therewith.

14. A rachet puller for nails, spikes, tacks, staples and elongated members having a shank embedded in a structure from which it is pulled, comprising a detachable pry tool having mounting means to rotatably mount to an elongated bar, including said elongated bar, rachet means operably connected between said pry tool and said elongated bar for rachet operation of said pry tool, said pry tool including an outer peripheral wall, grasping means at a point along said peripheral wall to grasp a said elongated member for pulling from said structure in which it is embedded, said grasping means being rachetable in a direction to pull a said elongated member from said structure in which it is embedded, said outer peripheral wall extending in an arcuate path for a distance of at least one hundred and eighty degrees.

15. A ratchet puller as set forth in claim 14, said ratchet means being included in an end portion of said elongated bar.

16. A ratchet puller as set forth in claim 14, wherein said grasping means includes a claw portion having a wedge shaped slot opening to said peripheral wall.

17. A ratchet puller as set forth in claim 16, wherein said arcuate peripheral wall terminates on one side of said pry tool at said claw portion, said pry tool including a pointed end portion, said arcuate peripheral wall terminating on the opposite side of said pry tool at said pointed end portion.

18. A ratchet puller as set forth in claim 15, wherein said ratchet means in said end portion of said elongated bar includes a connecting lug projecting therefrom, said mounting means of said pry tool includes a corresponding recess to receive said connnecting lug therein for mounting said pry tool to said elongated bar.

19. A ratchet puller for nails, spikes, tacks, staples and elongated members having a shank embedded in a structure from which it is to be pulled, comprising a detachable pry tool having mounting means to rotatably mount to an elongated bar, including said elongated bar, ratchet means operably connected between said pry tool and said elongated bar for ratchet operation of said pry tool, said pry tool including an outer peripheral wall, grasping means at a point along said peripheral wall to grasp a said elongated member for pulling from said structure in which it is embedded, said grasping means being rotatable through a circular path while grasping said elongated member thereby carrying said elongated member upwardly out of said structure in which it was embedded and over said peripheral wall of said pry tool as it travels in said circular path, wherein said grasping means includes a claw portion having a wedge shaped slot therein to receive the shank of a nail therein for pulling from a structure in which said nail is embedded, wherein said pry tool includes a body portion, a groove in said body portion axially aligned with said wedge shaped slot for laying a nail in said groove and through said slot to position said nail for starting and hammering into a pre-selected location.

20. A ratchet puller for nails, spikes, tacks, staples and elongated members having a shank embedded in a structure from which it is to be pulled, comprising a detachable pry tool having mounting means to rotatably mount to an elongated bar, including said elongated bar, ratchet means operably connected between said pry tool and said elongated bar for ratchet operation of said pry tool, said pry tool including an outer peripheral wall, grasping means at a point along said peripheral wall to grasp a said elongated member for pulling from said structure in which it is embedded, said grasping means being rotatable through a circular path while grasping said elongated member thereby carrying said elongated member upwardly out of said structure in which it was embedded and over said peripheral wall of said pry tool as it travels in said circular path, wherein said pry tool includes a pointed end portion to insert under the bight of a staple for pulling from a structure in which said staple is embedded, wherein said pry tool includes a bore through said pointed end portion, said bore having a diameter corresponding to that of a nail to be received through said bore for positioning said nail for starting prior to hammering into a pre-selected location.

21. A ratchet puller for nails, spikes, staples and elongated members having a shank embedded in a structure from which it is to be pulled, comprising a detachable pry tool having mounting means to rotatably mount to an elongated bar, including said elongated bar, ratchet means operably connected between said pry tool and said elongated bar for ratchet operation of said pry tool, said pry tool including an outer peripheral wall, grasping means at a point along said peripheral wall to grasp a said elongated member for pulling from said structure in which it is embedded, said grasping means being rotatable through a circular path while grasping said elongated member thereby carrying said elongated member upwardly out of said structure in which it was embedded and over said peripheral wall of said pry tool as it travels in said circular path, wherein said pry tool includes a body portion having an arcuate peripheral wall, said arcuate peripheral wall terminating at one circumferential side portion in a claw portion having a wedge shaped slot therein, said claw portion comprising said grasping means, said arcuate peripheral wall terminating at an opposite circumferential side portion in a pointed end portion, said claw portion and said pointed end portion each having respective pry surfaces facing oppositely from said arcuate peripheral wall.

22. A rachet puller for nails, spikes, tacks, staples and elongated members having a shank embedded in a structure from which it is to be pulled, comprising a detachable pry tool having mounting means to rotatably mount to an elongated bar, including said elongated bar, ratchet means operably connected between said pry tool and said elongated bar for ratchet operation of said pry tool, said pry tool including an outer peripheral wall, grasping means at a point along said peripheral wall to grasp a said elongated member for pulling from said structure in which it is embedded, said grasping means being ratchetable in a direction to pull a said elongated member from said structure in which it is embedded, wherein said grasping means includes a claw portion having a wedge shaped slot opening to said peripheral wall, wherein said arcuate peripheral wall terminates on one side of said pry tool at said claw portion, said pry tool including a pointed end portion, said arcuate peripheral wall terminating on the opposite side of said pry tool at said pointed end portion.

* * * * *